US006082334A

United States Patent [19]

Shomura et al.

[11] Patent Number: 6,082,334

[45] Date of Patent: Jul. 4, 2000

[54] ELECTRONICALLY CONTROLLED FUEL INJECTION TYPE TWO-STROKE ENGINE

[75] Inventors: Nobuyuki Shomura; Yukihiro Yoshikawa, both of Hamamatsu, Japan

[73] Assignee: Suzuki Motor Corporation, Shizuoka-ken, Japan

[21] Appl. No.: 09/268,984

[22] Filed: Mar. 16, 1999

[30] Foreign Application Priority Data

Mar. 30, 1998 [JP] Japan ..... 10-084509

[51] Int. Cl.[7] ..... F02M 51/00

[52] U.S. Cl. ..... 123/478; 123/486; 701/104

[58] Field of Search ..... 123/478, 486; 701/115, 104

[56] References Cited

U.S. PATENT DOCUMENTS

| | | | |
|---|---|---|---|
| 4,899,713 | 2/1990 | Nakamura | 123/486 |
| 5,190,008 | 3/1993 | Yamasaki et al. | 123/486 |
| 5,341,786 | 8/1994 | Abe et al. | 123/486 |
| 5,349,933 | 9/1994 | Hasegawa et al. | 123/486 |
| 5,749,376 | 5/1998 | Halvorson et al. | 123/486 |

FOREIGN PATENT DOCUMENTS 5-1018287 of 0000 Japan .

*Primary Examiner*—Erick Solis
*Attorney, Agent, or Firm*—Darby & Darby

[57] ABSTRACT

The present invention is to provide an electronically controlled fuel injection type two-stroke engine wherein the intake air amount can be determined with precision so that the fuel injection amount can be properly controlled in conformity with the varying conditions of the exhaust pressure, to thereby achieve an optimal air-fuel ratio and hence improve the output power, the fuel consumption and the exhaust performance.

For the computation of the correction value to the fuel injection amount based on the intake passage pressure, the actual throttle opening and engine speed are detected, and the intake pressure value P is detected at the same time. Then the corresponding basic intake pressure value is selected from the basic intake pressure map so as to calculate the difference between the basic intake pressure value and the detected intake pressure value. This difference corresponds to the difference in exhaust pressure between the base state and the actual run state (exhaust pressure varies depending upon the conditions such as the boat speed, forward/backward mode, the mounted position (height) and the number of the mounted engines and the like). From this difference, the correction value to the fuel injection amount based on the intake pressure is computed.

4 Claims, 9 Drawing Sheets

Intake passage pressure for varying throttle openings and engine speeds

| | | Engine speed | | | | |
|---|---|---|---|---|---|---|
| | | $N_1$ | $N_2$ | $N_3$ | ··· | $N_n$ |
| Throttle opening | $\theta_1$ | $P_{11}$ | $P_{12}$ | $P_{13}$ | ··· | |
| | $\theta_2$ | $P_{21}$ | $P_{22}$ | $P_{23}$ | ··· | |
| | ⋮ | ⋮ | ⋮ | ⋮ | | |
| | $\theta_n$ | | | | | $P_{nn}$ |

Basic intake pressure map

FIG. 11

(a)

Engine speed

| Computed value in the comparison | $N_1$ | $N_2$ | $N_3$ | ... | $N_n$ |
|---|---|---|---|---|---|
| $X_1$ | $Y_{11}$ | $Y_{12}$ | $Y_{13}$ | ... | |
| $X_2$ | $Y_{21}$ | $Y_{22}$ | $Y_{23}$ | | |
| ⋮ | ⋮ | | | | |
| $X_n$ | | | | | $Y_{nn}$ |

(b) When X=A, Y=Ann

Engine speed

| Throttle opening | $N_1$ | $N_2$ | $N_3$ | ... | $N_n$ |
|---|---|---|---|---|---|
| $\theta_1$ | $A_{11}$ | $A_{12}$ | $A_{13}$ | ... | |
| $\theta_2$ | $A_{21}$ | $A_{22}$ | $A_{23}$ | | |
| $\theta_3$ ⋮ | ⋮ | | | | |
| $\theta_n$ | | | | | $A_{nn}$ |

When X=B, Y=Bnn

| | $N_1$ | $N_2$ | $N_3$ | ... |
|---|---|---|---|---|
| $\theta_1$ | $B_{11}$ | $B_{12}$ | $B_{13}$ | ... |
| $\theta_2$ | $B_{21}$ | $B_{22}$ | $B_{23}$ | |
| ⋮ | ⋮ | | | |
| $\theta_n$ | | | | $B_{nn}$ |

Similarly, when X=C, Y=Cnn
when X=D, Y=Dnn
when X=E, Y=Enn
⋮ ⋮

ELECTRONICALLY CONTROLLED FUEL INJECTION TYPE TWO-STROKE ENGINE

BACKGROUND OF THE INVENTION (1) Field of the Invention

The present invention relates to an electronically controlled fuel injection type two-stroke engine.

(2) Description of the Related Art

Some types of engines use a fuel injection device for mixing intake air with fuel, instead of a carburetor. The fuel injection device directly injects the fuel into air in the intake air passage so as to deliver the air-fuel mixture to the engine.

A typical fuel injection device has a microcomputer as a central processing unit (CPU), which computes the amount of fuel to be injected based on the detection signals (data) from various sensors, and controls the amount of fuel injected from the injector by the output signal.

Since the exhaust port of a typical engine is open to the air, in computing the intake air amount of the engine, the basic air amount is calculated based on throttle opening (angle) and engine speed (revolution), and the calculated air amount is then further corrected based on the intake air temperature, the engine temperature, the coolant temperature, the atmospheric pressure, etc., to determine the fuel injection amount. This control system shows good throttle response.

Alternatively, Japanese Patent Application Laid-Open Hei 5 No. 18,287 discloses a system in which the exhaust pressure is sensed to correct the injected fuel amount.

However, in a case of an outboard motor engine used in a motor boat etc., the exhaust outlet of the engine is under water, the pressure of the exhaust passage is varied by the boat speed, the hull shape, the mounted position of the engine, running mode such as forward, backward and neutral, and the like. For such outboard motor engines as well as engines of which the exhaust system pressure is varied by some external factors, there are cases where the air amount computed based on the throttle opening and the engine speed and corrected based on the intake air temperature etc. differs from the air amount in an actual operation and this may cause troubles such as engine output lowering, degradation of fuel consumption and deterioration of the exhaust gas.

In contrast, in the techniques, as disclosed in the above publication, for correcting the fuel injection amount based on the exhaust pressure, disposing a sensor in the exhaust port requires a costly pressure-resistant and heat-resistant sensor and lowers the reliability of the sensor, because the temperature and pressure around the exhaust port are high. Further, the placement of the exhaust pressure sensor is difficult since the coolant passage and the scavenging port are arranged near the exhaust port.

SUMMARY OF THE INVENTION

It is therefore an object of the present invention to provide an electronically controlled fuel injection type two-stroke engine wherein the intake air amount is determined with precision so that the fuel injection amount is properly controlled in conformity with the varying conditions of the exhaust pressure, to thereby achieve an optimal air-fuel ratio and improve the output power, the fuel consumption and the exhaust performance.

According to the present invention, there is provided an electronically controlled fuel injection type two-stroke engine wherein a basic air amount is determined based on throttle opening and engine speed (revolution) so that a proper amount of fuel is injected from an injector into an intake air passage, comprising:

a pressure sensor for detecting an actual intake pressure in the intake air passage;

a memory for storing basic intake pressure values (data) in the intake air passage with respect to various throttle openings and with respect to various engine speeds under a basic state; and an arithmetic processor for determining correction value (data) to a basic fuel injection amount corresponding to the basic air amount, based on difference between the basic intake pressure value corresponding to actual throttle opening and to actual engine speed and the detected intake pressure value (data) detected by the pressure sensor.

The engine of the invention may further include a memory for storing the correction values (data) to the fuel injection amount for various differences between the basic intake pressure value and the detected intake pressure value.

The engine may be configured so that, in determining the correction value to the fuel injection amount based on the difference between the basic intake pressure value and the actual detected intake pressure value, if the actual engine speed or the actual throttle opening is not less than a certain preset value (data), the arithmetic processor adopts the correction value to the fuel injection amount corresponding to the preset value.

Further, the correction value to the fuel injection amount may include corrections based on the actual engine speed or the actual throttle opening.

The engine of the invention is suitable for outboard motors, general-purpose engines, lawn mowers, jet-skis, etc., and is particularly preferable for outboard motors.

BRIEF DESCRIPTION OF THE DRAWINGS

FIG. 11(*a*) is a map of correction values to the fuel injection amount including correction based on engine speed; and FIG. 11(*b*) is maps of correction values to the fuel injection amount including correction based on engine speed and throttle opening.

DESCRIPTION OF THE PREFERRED EMBODIMENT

Figure 1:
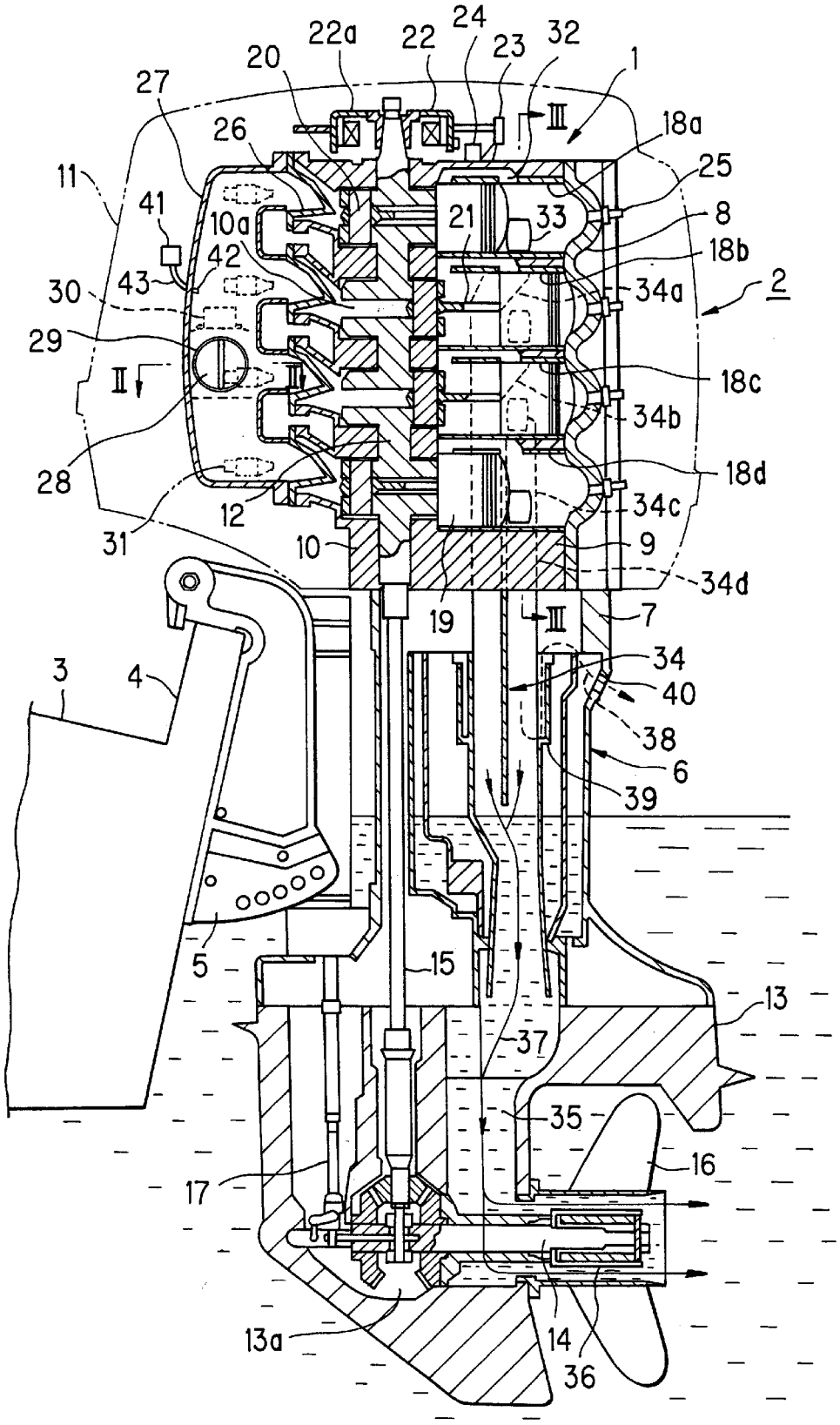
FIG. 1 is a left-side vertical sectional illustration of an outboard motor having an electronically controlled fuel injection type two-stroke engine in accordance with an embodiment of the invention.

According to the knowledge of the present inventors, a four-stroke engine has exhaust and intake valves so that they perform independent intake and exhaust strokes from each other. Accordingly, at typical valve timing, the intake stroke is stable and hence it is possible to determine the basic air amount from the intake pressure and engine speed. In contrast, a two-stroke engine, which has no intake and exhaust valves, effects scavenging that is gas exchange by expelling exhaust gases from the cylinder whilst replacing them with temporarily compressed intake air (fresh air). Therefore, the exhaust pressure and the scavenging pressure significantly affect the intake pressure, although this depends upon the scavenging and exhausting timings and upon the performance of the lead valve. In this way, the unsteadiness of gas exchange induces an unstable combustion state, causing instability in the exhaust pressure and the scavenging pressure, which leads to instability in the intake pressure, resulting in further instability in gas exchange, setting up a vicious cycle.

As stated above, because a two-stroke engine has no intake and exhaust valves and hence is affected by various factors, it is difficult to determine the basic air amount from the intake pressure and engine speed. Therefore, the basic air amount is determined based on throttle opening and engine speed and this is followed by correction. However, if, for this correction, filtering and averaging processes are carried out to the extent that the fluctuation of the intake pressure is absorbed, the response will degrade.

Because of such circumstances, the inventors hereof have devised and completed the present invention of making correction to the fuel injection amount by taking notice of the fact that the combustion is relatively stable from the medium to high range of engine speed range though it depends on the engine characteristics and the influences of the exhaust pressure in that range can be predicated from the intake pressure as stated above.

More specifically, in accordance with the invention, since the basic air amount of a two-stroke engine is determined based on throttle opening and engine speed, the configuration of the invention has the advantage of providing a good throttle response.

In the invention, the intake pressure in the intake air passage is detected, while the basic intake pressure values in the intake air passage for various throttle openings and for various engine speeds under basic conditions are measured and stored in advance, so that the basic intake pressure value corresponding to an actual throttle opening and to an actual engine speed is compared to the detected intake pressure value to determine the correction value to the basic fuel injection amount corresponding to the basic air amount based on the difference in the above comparison.

Accordingly, it is possible to make an exact correction to the fuel injection amount in conformity with the varying exhaust pressure, whilst maintaining the above advantage. Resultantly, it is possible to improve the output power, the fuel consumption and the exhaust performance.

Further, in the present invention, the intake pressure sensor which has conventionally been used to detect the atmospheric pressure is used to detect the intake passage pressure, it is possible to obtain the above effect by only partly modifying the system (modifying partly the unit input circuit and the program), thus producing remarkable advantages in manufacture and in cost.

If the pressure is attempted to be detected at the exhaust passage in order to directly determine the influence of the exhaust passage, an extra cost will be needed. Because the pressure value in the exhaust passage is high, particularly in an outboard motor engine, the sensor needs measures against the heat and water and salt infiltration. On the contrary, when the pressure is detected at the intake air passage, a typical atmospheric pressure (intake pressure) sensor can be used as stated above, which provides cost and reliability advantages.

In order to determine the correction value to the fuel injection amount based on the difference between the basic intake pressure value and the detected intake pressure value, when actual engine speed or throttle opening is equal to or above the set value, the correction value to the fuel injection amount based on the difference between the basic intake pressure value and the detected intake pressure value corresponding to the set value is used.

Illustratively, in some cases depending upon the displacement and the throttle valve size, when the throttle opening is greater than a certain level, air amount capable of passing through the intake air passage exceeds the amount of air required for the engine, the intake pressure becomes close to the atmospheric pressure, so that the difference in intake air amount will become unclear. Because of this factor, when the actual engine speed or the actual throttle opening is equal to or above the set value, the correction value to the fuel injection amount based on the difference between the basic intake pressure value and detected intake pressure value corresponding to the set value may be used. This configuration can partially reduce the data of the correction values to the fuel injection amount, making for a higher speed computing process with a lower memory capacity.

Moreover, since the correction value to the fuel injection amount includes correction based on the actual engine speed or the actual throttle opening, it is possible to make corrections to the fuel injection amount more finely conforming to the engine characteristics.

Now, the embodiment of the present invention will be described in detail with reference to the drawings. FIGS. 1 through 5 are illustrative views of an outboard motor 2 incorporating an electronically controlled fuel injection type two-stroke engine (internal-combustion engine) 1 in accordance with the embodiment. FIG. 6 is a block diagram illustrating an electronic control unit 45 of engine 1 and input/output configurations.

Engine 1 of this embodiment is an electronically controlled fuel injection type two-stroke engine and includes a control unit 45 which determines the basic air amount based on the opening of a throttle valve 28 and the engine speed and electronically controls the injection of a proper amount of fuel from injectors 31 into the intake air passages of engine 1.

As shown in FIGS. 1 through 5, outboard motor 2 is mounted to a transom 4 of a hull 3 by means of a bracket 5. Outboard motor 2 has a drive shaft housing 6 which extends vertically at the rear of bracket 5 and is of a hollow body having an overall horizontal section of a fusiform. Formed over drive shaft housing 6 is an engine holder 7, on which engine 1 is mounted.

This engine 1 is of a multiple cylinder (e.g., four cylinders) two-stroke engine having a cylinder head 8, a cylinder block 9 and a crankcase 10. A crankshaft 12 is axially supported inside crankcase 10 in the approximately vertical direction so that it is rotatable. The outer face of engine 1 is enclosed by an engine cover 11.

A gear casing 13 is provided under drive shaft housing 6. This gear casing 13 rotatably supports a propeller shaft 14 having a propeller 16 directed horizontally to the rear. This propeller shaft 14 is provided with a gear set 13*a* for transmitting the drive force from a drive shaft 15 such that the rotational speed is reduced and the direction of rotation is changed. This gear set 13*a* has a pair of output bevel gears opposing each other and is spline-coupled to the aforementioned propeller shaft 14. A shift mechanism 17 is provided in the front of propeller shaft 14. This shift mechanism 17 is adapted for transmitting the power of engine 1 to propeller shaft 14 so as to rotate either in a forward or reverse direction, or to be set into neutral (non-drive mode), by dog coupling one of the pair of the opposing output bevel gears with propeller shaft 14 or disengaging it from either of them, by remote control using rods and/or links. It should be noted that the shift mechanism may have an unillustrated shift position detector.

Provided inside cylinder block 9 of engine 1 are multiple (four) cylinders 18. In FIG. 1, these are named first cylinder 18*a*, second cylinder 18*b*, third cylinder 18*c* and fourth cylinder 18*d*, from the top to the bottom. Each of these cylinders 18*a*, 18*b*, 18*c* and 18*d* accomodates a piston 19 that is slidable within and is coupled to a crank pin 20 of a crankshaft 12 by a connecting rod 21 so that the reciprocating motions of pistons 19 are converted into rotating motion of crankshaft 12.

An ignition plug 25 is screwed at the upper end of each of cylinders 18*a*, 18*b*, 18*c* and 18*d* so as to have access to the cylinder combustion chamber.

Figure 2:
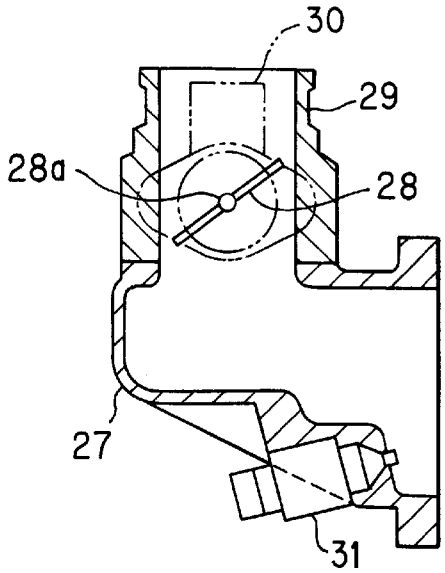
FIG. 2 is a sectional view taken along a line II—II of FIG. 1.
Figure 3:
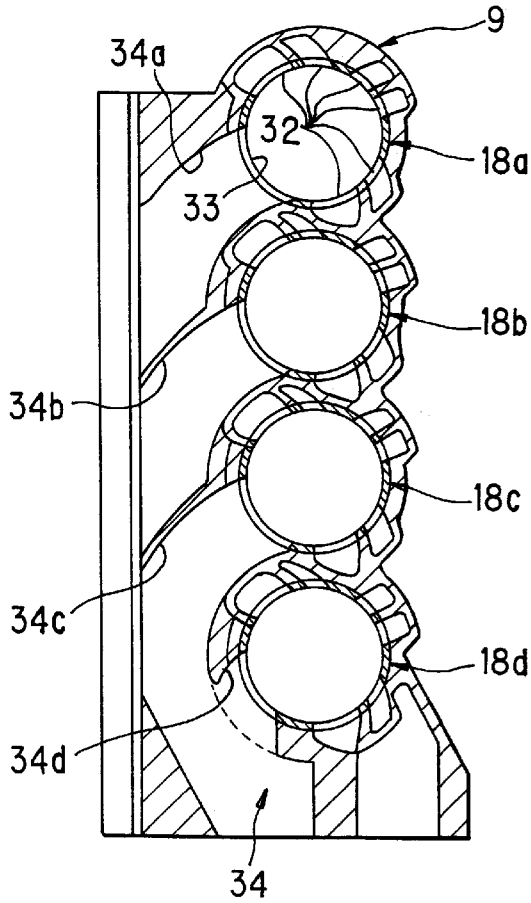
FIG. 3 is a sectional view taken along a line III—III of FIG. 1.
Figure 4:
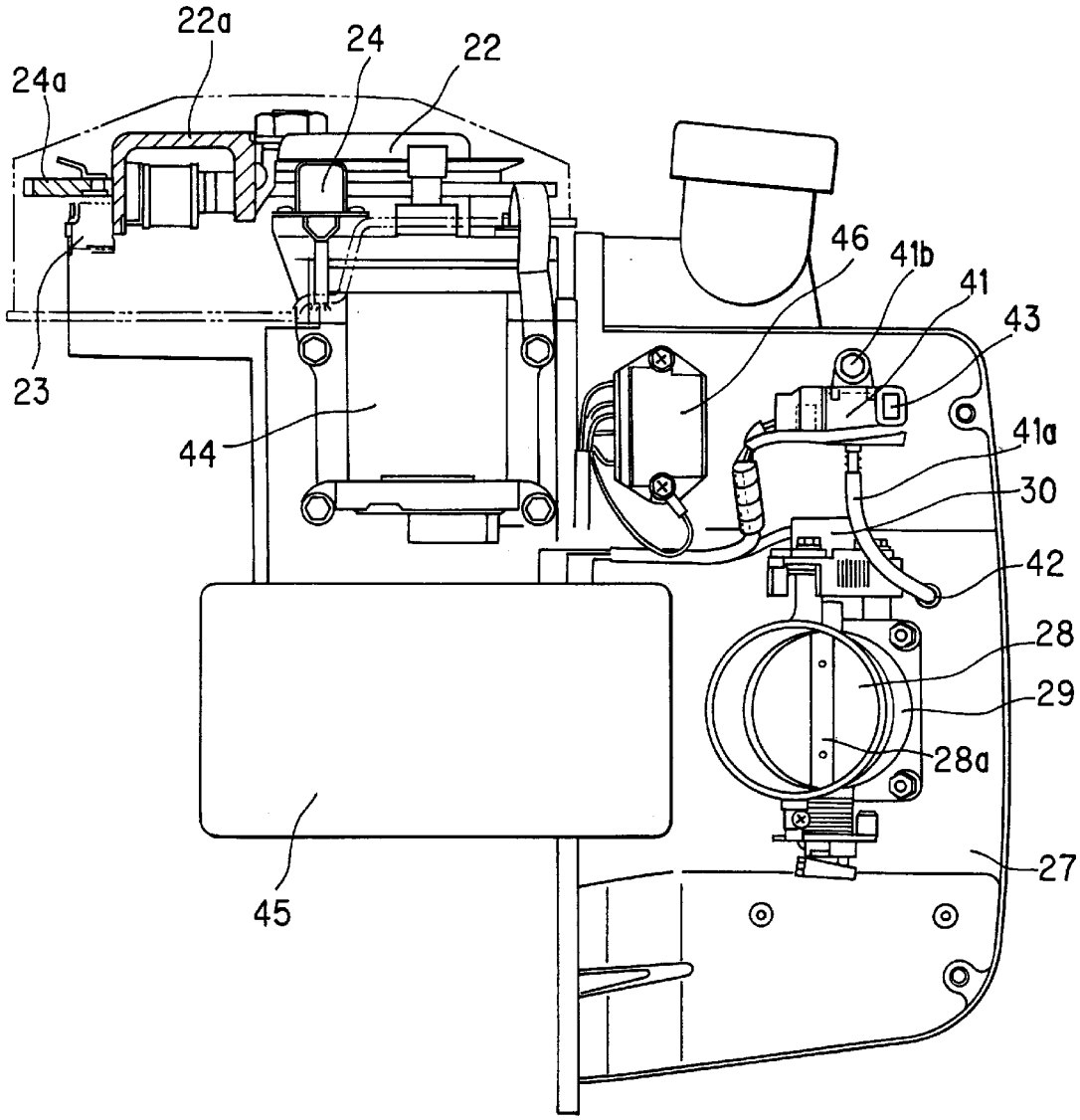
FIG. 4 is a right-side view encompassing the engine of FIG. 1.
Figure 5:
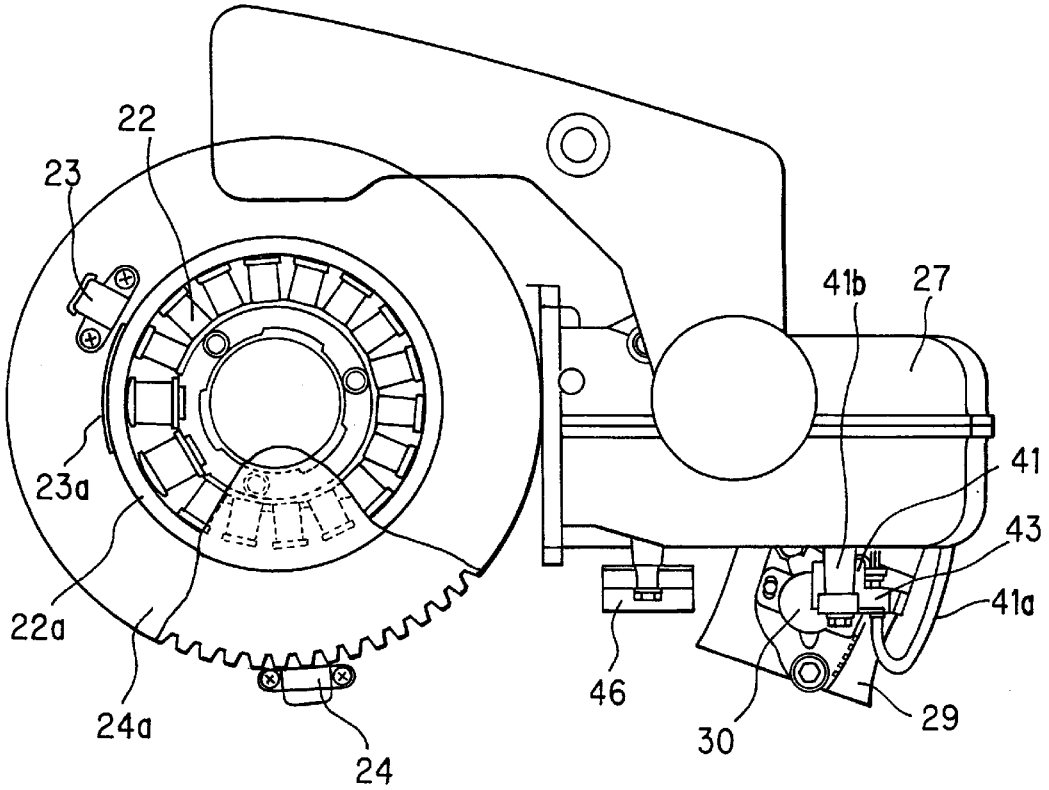
FIG. 5 is a top view encompassing the engine of FIG. 1.
Figure 6:
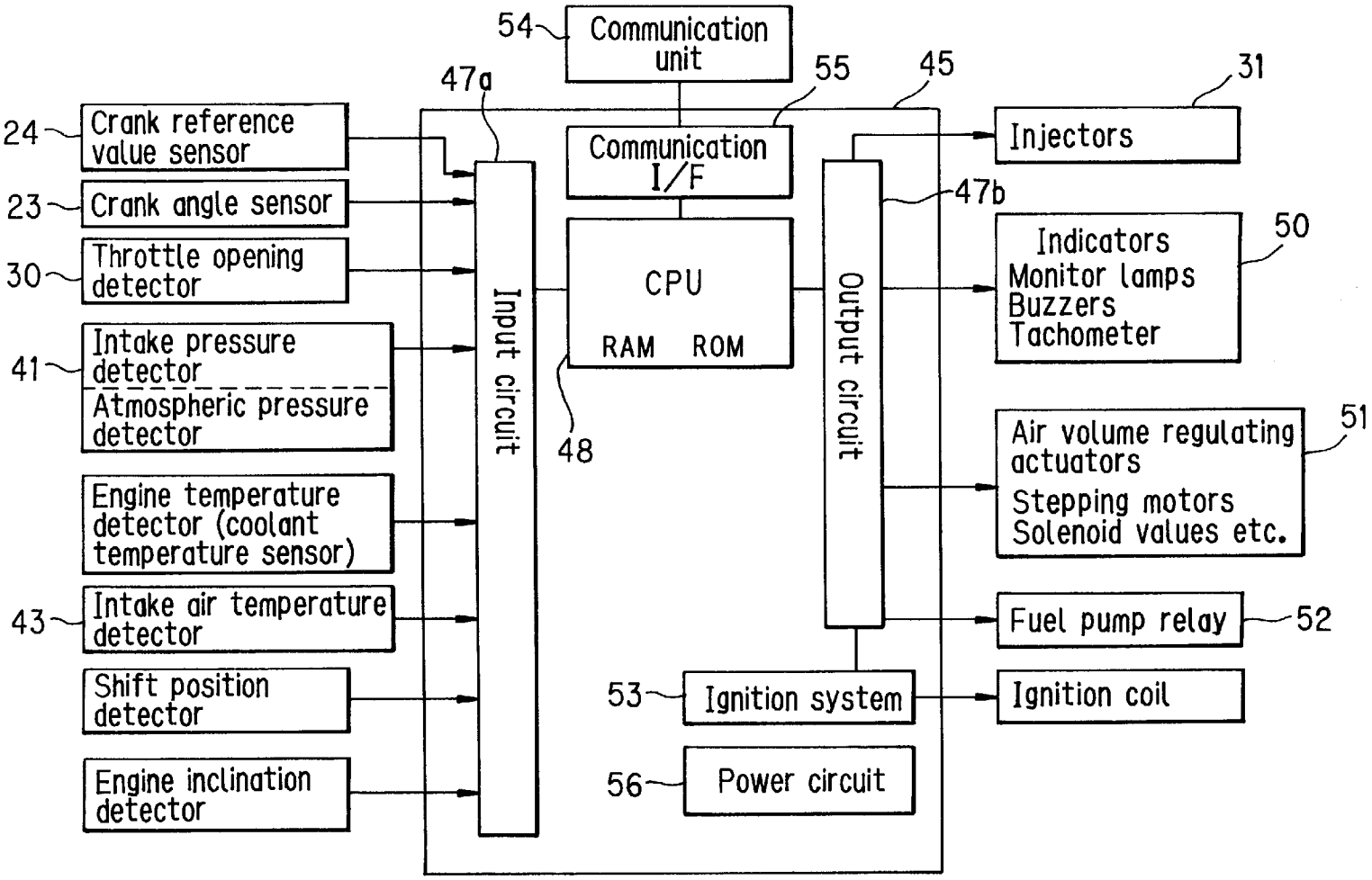
FIG. 6 is a block diagram showing an electronic control unit of the engine of FIG. 1.

FIG. 2 is a sectional view cut along a line II—II in FIG. 1, FIG. 3 is a sectional view cut along a line III—III in the same figure, FIG. 4 is a right-side view encompassing engine 1, and FIG. 5 is a top view of the same engine.

As shown in FIGS. 1, 4 and 5, a rotor 22*a* of a magneto 22 is fixed on the top of crankshaft 12. A crank reference position sensor 23 is opposed to the outside periphery of this rotor 22*a*. This sensor 23 detects the predetermined reference position of the crankshaft by detecting a dog 23*a* (one pulse per one revolution). Fixed to rotor 22*a* is a gear-shaped disc dog 24*a*, opposite which a crank rotational angle sensor 24 for detecting angles of the crankshaft 12 (multiple pulses per one revolution) is disposed.

As shown in FIGS. 2 through 5, formed on the fore side of crankshaft 12 of crankcase 10 are air-fuel mixture intake ports to crank chamber 10*a*. Each port has a lead valve device 26 functioning as the check valve for a corresponding cylinder (e.g., 18*a*, . . . ). A surge tank 27 of an approximately box shape as part of the intake air passage is disposed on the upstream side on the fore side adjacent to the lead valve devices 26.

Connected to the central portion on the right side of surge tank 27 is an intake pipe 29 having a throttle valve 28 which can be opened and closed about a vertical rotation shaft 28*a*. Over this intake pipe 29, a throttle opening sensor 30 for detecting the opening of throttle valve 28 is linked at the end of the shaft 28*a*. An unillustrated air cleaner is connected on the upstream side of intake pipe 29.

Further, fuel injectors 31 are attached inside surge tank 27 on the side opposite to intake pipe 29, that is, on its left side surface, at positions corresponding to appropriate cylinders 18. Each injector 31 is arranged so as to inject fuel toward each lead valve device 26 for each cylinder 18.

Turning to FIGS. 1 and 3, the downstream side of each lead valve device 26 communicates with a corresponding crank chamber 10*a* inside crankcase 10 and the chamber communicates with a corresponding scavenging port 32 formed in cylinder block 9. Each scavenging port 32 is open to the inner peripheral surface of cylinder 18 (18*a*, 18*b*, 18*c* or 18*d*). Formed on the inner peripheral surface of cylinder 18 is an exhaust port 33 from which an exhaust passage 34 (34*a*, 34*b*, 34*c* or 34*d*) is extended toward drive shaft housing 6 located below.

An exhaust passage 34a from first cylinder 18*a* and an exhaust passage 34*b* from second cylinder 18*b* join partway extending to the approximate center of drive shaft housing 6. In a similar manner an exhaust passage 34*c* from third cylinder 18*c* and an exhaust passage 34*d* from fourth cylinder 18*d* join partway extending to the approximate center of drive shaft housing 6, where they join with exhaust passages 34*a* and 34*b*. The end of exhaust passage 34 opens to an exhaust chamber 35 inside gear casing 13, and an exhaust chamber 35 communicates with a final exhaust passage 36 formed around propeller shaft 14.

When a boat of the embodiment is on the water surface of the sea or a lake etc., with outboard motor 2 set on a hull 3, the lower half of drive shaft housing 6 and gear casing 13 are under water. When engine 1 is off, the lower half of exhaust passage 34, exhaust chamber 35 and final exhaust passage 36 are immersed in water. This water is pushed down by the exhaust gas pressure when engine 1 is activated, so that the gas is discharged into the water, as indicated by solid arrows 37 in FIG. 1. During engine idling or during running at low speeds, the exhaust pressure is not high enough to push the water down. Therefore, the exhaust gas is discharged to the atmosphere following a bypass passage 39 formed in the rear of drive shaft housing 6 to a sub-exhaust port 40 opening to the rear side, as indicated by a broken arrow 38 in FIG. 1.

As detailedly shown in FIGS. 4 and 5, an intake pressure sensor 41 which can be also used as an atmospheric pressure sensor is fixedly secured to a projected boss 41*b* above intake pipe 29 on the right-side portion of surge tank 27 upstream of lead valve devices 26. This intake sensor 41 is connected to an intake pressure detection hole 42 opening in the surge tank 27 above and near intake pipe 29 by means of a pressure conductor (flexible hose etc.) 41*a* so as to detect the intake pressure.

Since the intake air amount of one cylinder 18 slightly differs from the others, intake pressure detection hole 42 is laid out at a position where the intake pressure is relatively stable, for example, at a site away from lead valve devices 26. Intake pressure sensor 41 is not limited to being a single configuration as shown in FIG. 4, a multiple number of sensors, e.g., four sensors may be provided, one for each, for the respective cylinders 18.

An intake air temperature sensor 43 is secured to the boss 41*b* adjacent to intake pressure sensor 41.

In the right-side portion of engine 1, a starting motor 44 for starting engine 1 is provided on the top of engine 1, while a control unit (ECU) 45 opposing the center of engine 1 is provided inside a box-like casing. A regulator and rectifier unit 46 is arranged adjacent to starting motor 44.

Although unillustrated, an engine temperature sensor for detecting the coolant temperature may be provided.

FIG. 6 shows a control system of an outboard motor centering control unit 45. As shown in FIG. 6, control of the fuel injection amount from fuel injector 31 by control unit 45 is performed basically based on the speed of revolution of engine 1, the opening of throttle valve 28 to determine the basic air amount (determine the basic fuel injection amount), while also detecting the intake pressure within the intake air passage to the engine 1 so as to determine the correction values to the fuel injection amount to thereby correct the basic fuel injection amount based on this correction values.

Specifically, the atmospheric pressure, the coolant temperature and the intake air temperature are detected by appropriate sensors and the data of detected values are inputted into control unit 45 via an input circuit 47*a*. In control unit 45, a CPU (central processing unit) 48, including a microcomputer, RAM and ROM, computes the intake air amount based on the data and makes various corrections to the intake air amount and then computes an optimal fuel injection amount and outputs the result to fuel injectors 31 by way of an output circuit 47*b*. Each fuel injector 31 injects the optimal amount of fuel corresponding to the intake air amount by duty control.

Other outputs from control unit 45 are issued to various indicators 50 such as monitor lamps, buzzers, a tachometer etc., air volume regulating actuators 51 such as stepping motors, solenoid valve etc., a fuel pump relay 52 and an ignition system 53 such as ignition coils etc.

The control unit 45 further includes a communication interface 55 which receives signals such as operating instructions etc., transferred via a communication unit 54 from the maneuvering unit arranged in front of the operator and inputs them into CPU 48. Battery power and the generated power from magneto 22 are input to a power circuit 56.

Now, the operation of two-stroke engine 1 for the outboard motor 2 of this embodiment will be described.

Figure 7:
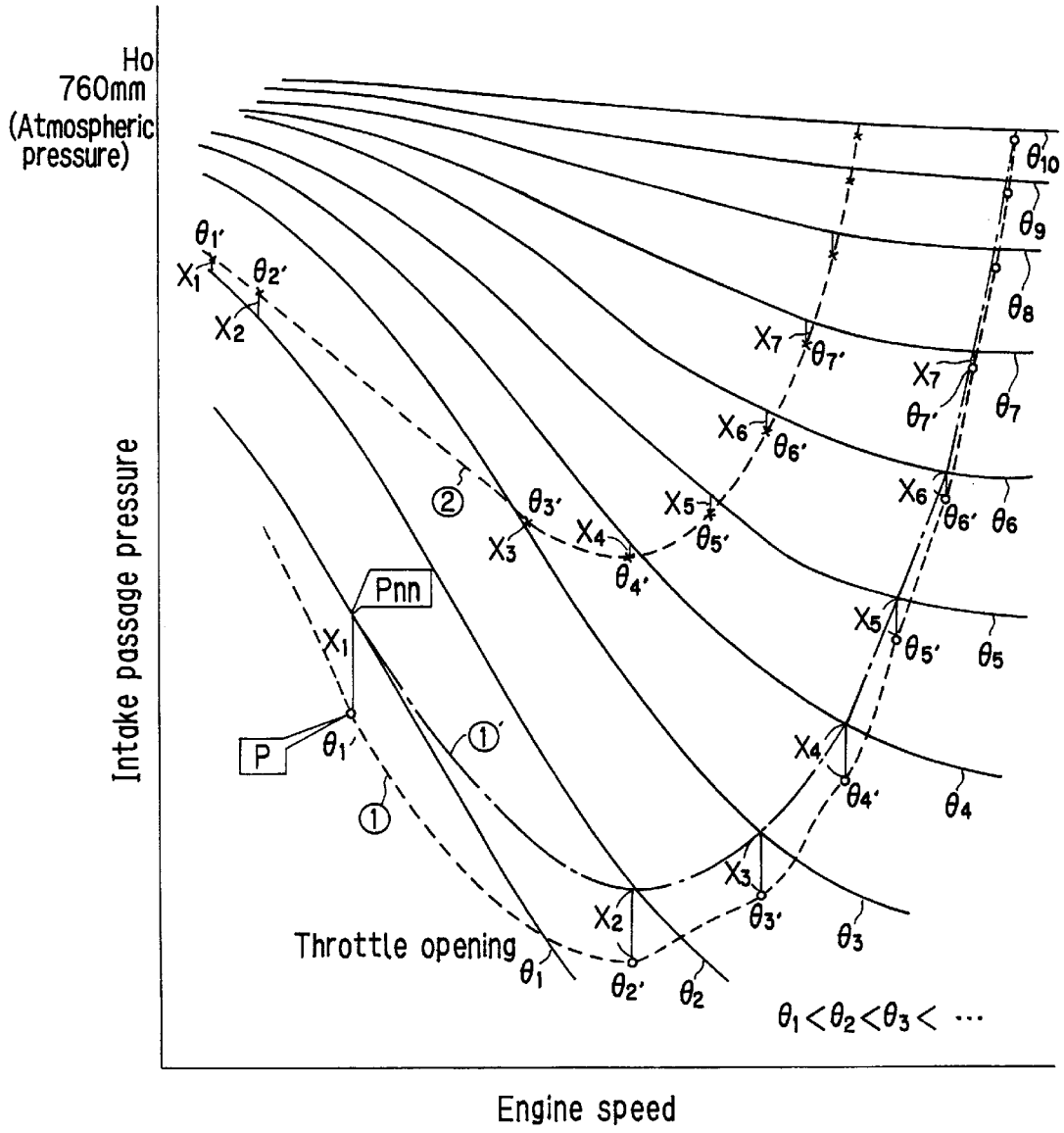
FIG. 7 is a chart showing the characteristics of intake pressure with respect to throttle opening and with respect to engine speed.
Figures 8, 9:
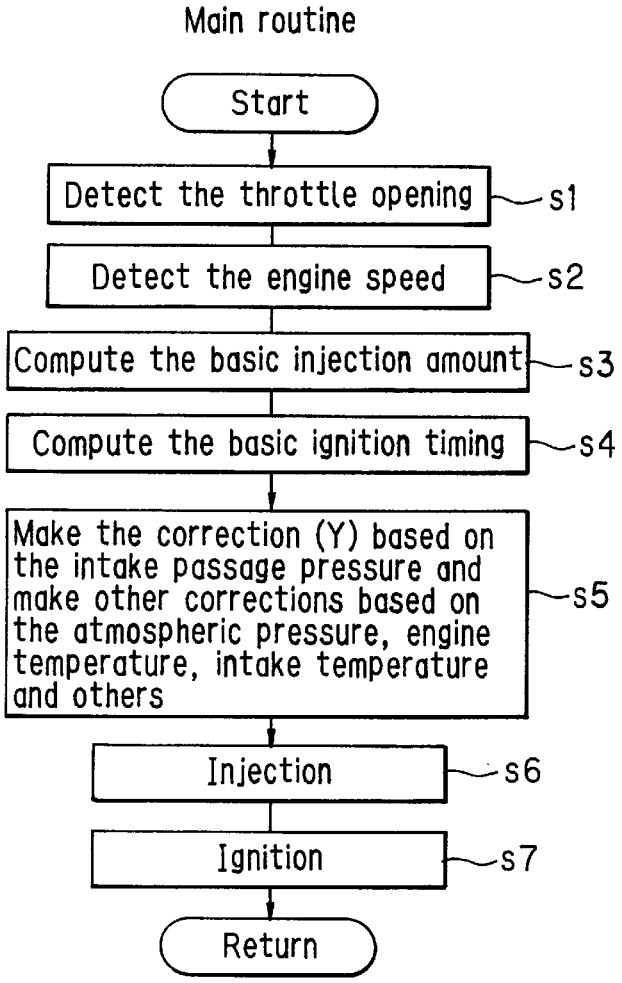
FIG. 8 is an example of a 3D map of basic intake pressure values of the intake system.
FIG. 9 is a control flowchart of the main routine.
Figure 10:
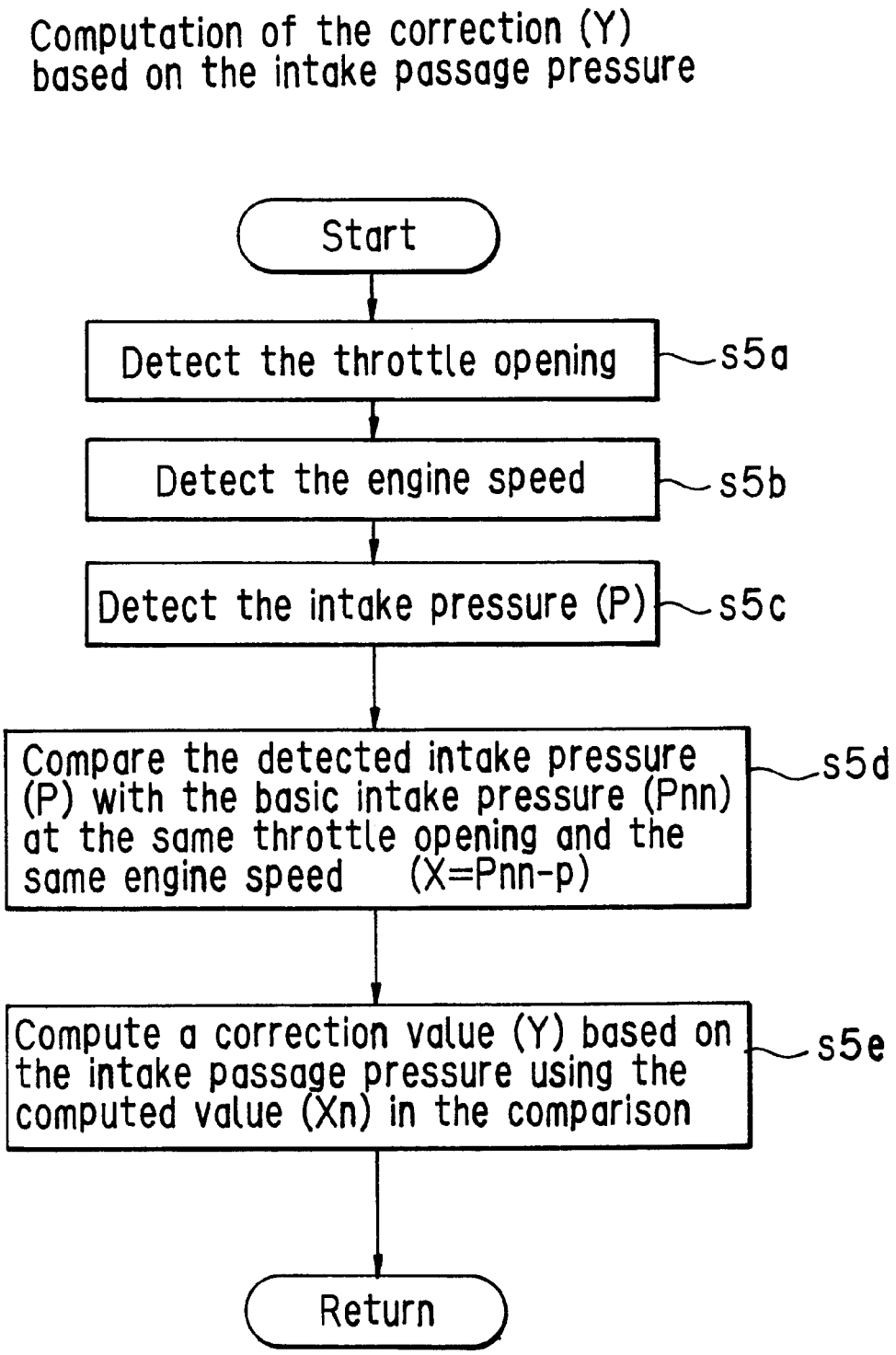
FIG. 10 is a routine that computes a correction value (Y) to a fuel injection amount.

FIG. 7 is a chart showing the characteristics of the intake pressure with respect to throttle opening and with respect to engine speed. FIG. 8 is a 3D (three-dimensional) map of basic intake pressure values of the intake system. FIG. 9 is a control flowchart of the main routine. FIG. 10 is a routine that computes a correction value (Y) to the fuel injection amount. FIG. 11 shows maps of correction values to the fuel injection amount.

For engine 1 of the embodiment, the basic intake pressure values, that is intake pressure value in the base state (for example, placed on an engine bench in a laboratory) at various throttle openings and various engine speeds, are measured by experiment, and the values are stored in control unit 45, in advance. The exhaust passage pressure varies depending upon an actual run state such as the boat speed, forward/backward motion, the outboard motor mounted position, the number of motors and the like. During an actual run state, the actual intake pressure is detected and the detected intake pressure value is compared with the basic intake pressure value at the same throttle opening as actual one and the same engine speed as actual one. Correction value (Y) to the fuel injection amount are computed from the result of the comparison.

More specifically, as shown in FIG. 7, the intake pressure in the base state presents substantially constant value at certain throttle opening and certain engine speed. This tendency is more clear in medium and high range of engine speed in which the fluctuation of engine speed is little. This base intake pressure is measured by experiment and the measurements are stored in the memory of control unit 45, as shown in FIG. 8, in a three-dimensional map form between throttle opening, engine speed and basic intake pressure.

As in the main routine shown in FIG. 9, control of the fuel injection amount is performed in the following steps of: detecting actual throttle opening by throttle opening sensor 30 (Step 1); detecting actual engine speed by crank-angle sensor 23 or 24 (Step 2); computing the basic air amount and the basic fuel injection amount based on these detected values and the desired detection values (Step 3); computing the basic ignition timing (step 4); making corrections to the fuel injection amount based on the correction value (Y) computed by the detected value of the actual intake passage pressure and based on the other conditions such as the atmospheric pressure, the engine temperature, intake air temperature, etc. (Step 5); controlling the fuel injection from the injectors 31 based on the corrected injection amount (Step 6); and controlling the ignition timing (Step 7).

As shown in FIG. 10, the computation of the correction value (Y) to the fuel ignition amount based on the intake passage pressure at Step 5 comprises the steps of: detecting actual throttle opening and actual engine speed (Steps 5*a* and 5*b*); detecting actual intake pressure value (P) by the detection signal from intake pressure sensor 41 (Step 5*c*); and selecting one basic intake pressure value Pnn from the basic intake pressure map shown in FIG. 8 to calculate the difference Xn (=Pnn−P) between the basic intake pressure value Pnn and the detected intake pressure value P (Step 5*d*). This difference Xn corresponds to the difference in exhaust pressure between the base state and the actual run state (the exhaust pressure varies depending upon the conditions such as boat speed, forward/backward motion, the mounted position (height), the number of engines and the like). This difference Xn is used to compute the correction value Y to the fuel injection amount based on the intake pressure (step 5*e*). Here, as the map for the correction values Y, FIG. 11(*a*) is a map of correction values ($Y_{11}$, $Y_{12}$ . . . ) which is prepared by taking into account the corrections for each engine speed ($N_1$, $N_2$ . . . ) and FIG. 11(*b*) is a map of correction values ($A_{11}$, $A_{12}$ . . . ) which is prepared by taking into account the correction for each engine speed ($N_1$, $N_2$ . . . ) and for each throttle opening ($\theta_1$, $\theta_2$ . . . ). The optimal value of each correction value to the fuel injection amount can be determined by experimentation.

The characteristic curves ① and ② in FIG. 7 show the relationships between the engine speed and the intake pressure for different throttle openings ($\theta_1'$, $\theta_2'$ . . . ) for respective actual run states ① and ②, differing from each other. The relationship indicated by the characteristic curve ② is for a heavier load (low in engine speed even at the same throttle opening, e.g., $\theta_1$). The characteristic curve ①' shows the intake passage pressure in the base state (e.g., on an engine bench etc in a laboratory) for the same throttle opening and the same engine speed as those of the characteristic curve ①. Even at the same throttle opening and the same engine speed, the exhaust passage pressure difference X(=Pnn−P) varies as $X_1$ to $X_7$ under the conditions during an actual run so that the correction value Ynn to the fuel injection amount is determined by taking into account the influence of the engine speed.

Here, in some cases depending upon the displacement and the throttle valve size, when throttle opening (or engine speed) is greater than a certain level, air amount capable of passing through the intake air passage exceeds the amount of air required for the engine, and the intake pressure becomes close to the atmospheric pressure, so that change in throttle opening (or engine speed) make little difference in intake air amount. For this reason, when an actual throttle opening (or engine speed) is not less than a certain set throttle opening (or set engine speed), the intake pressure value difference X at the set throttle opening (or set engine speed) is used. For example, when the opening is greater than $\theta_5$ (i.e., $\theta_6$ to $\theta_{10}$), the pressure value difference X (i.e., $X_6$ to $X_{10}$) is not calculated, and the pressure value difference $X_5$, which is the one at a throttle opening of $\theta_5$, is used as an approximation to determine the correction value Y to the fuel injection amount based on the map (a) or (b) in FIG. 11. As already stated, use of map (a) or (b) in FIG. 11 provides correction including the engine speed and/or throttle opening.

It is also possible to use the intake pressure sensor 41 in the intake air passage as the atmospheric pressure (boost) sensor. In particular, in the case of an outboard motor, the sensor is rarely used to measure the atmospheric pressure because the variation is very small during running. Therefore, this intake pressure sensor is used to detect the atmospheric pressure when the electric power is activated before starting the engine, and it can be used as the intake passage pressure after the start of the engine. Of course, the intake pressure sensor may be provided separately from the atmospheric pressure sensor within the scope of the invention.

What is claimed is:

1. An electronically controlled fuel injection type two-stroke engine wherein a basic air amount is determined based on the throttle opening and engine speed so that a proper amount of fuel is injected from an injector into an intake air passage, comprising:

a pressure sensor for detecting actual intake pressure in the intake air passage;

a memory for storing basic intake pressure values in the intake air passage with respect to various throttle openings and with respect to various engine speeds under a basic state; and an arithmetic processor for determining the correction value to a basic fuel injection amount corresponding to the basic air amount, based on difference between the basic intake pressure value corresponding to actual throttle opening and to actual engine speed and the detected intake pressure value detected by the pressure sensor.

2. The electronically controlled fuel injection type two-stroke engine according to claim 1, further comprising a memory for storing the correction values to the fuel injection amount for various differences between the basic intake pressure value and the detected intake pressure value.

3. The electronically controlled fuel injection type two-stroke engine according to claim 1, wherein, in determining the correction value to the fuel injection amount based on the difference between the basic intake pressure value and the detected intake pressure value, if the actual engine speed or the actual throttle opening is not less than a certain preset value, the arithmetic processor adopts the correction value to the fuel injection amount corresponding to the preset value.

4. The electronically controlled fuel injection type two-stroke engine according to claim 1, wherein the correction value to the fuel injection amount includes corrections based on the actual engine speed or the actual throttle opening.

* * * * *